United States Patent [19]

Lems et al.

[11] Patent Number: 4,841,711

[45] Date of Patent: Jun. 27, 1989

[54] METHOD OF MAKING A FILM ENCASED PACKAGE

[75] Inventors: Peter Lems, Wilmette; Edward J. Slomski, Woodstock, both of Ill.

[73] Assignee: Illinois Tool Works Inc., Chicago, Ill.

[21] Appl. No.: 204,032

[22] Filed: Jun. 8, 1988

[51] Int. Cl.[4] ..... B65B 13/10; B65B 21/24

[52] U.S. Cl. ..... 53/398; 53/441; 53/449

[58] Field of Search ..... 53/48, 156, 157, 176, 53/398, 441, 442, 445, 447, 449, 540, 556, 588

[56] References Cited

U.S. PATENT DOCUMENTS

| | | | |
|---|---|---|---|
| 2,874,835 | 2/1959 | Poupitch | 53/48 X |
| 3,032,943 | 5/1962 | Reimers et al. | 53/585 X |
| 3,331,503 | 7/1967 | Brown | 53/442 X |
| 3,383,828 | 5/1968 | Cunningham | 53/580 X |
| 3,385,429 | 5/1968 | Becker et al. | 206/432 X |
| 3,959,949 | 6/1976 | Benno et al. | 53/441 X |
| 4,050,220 | 9/1977 | Lancaster et al. | 53/550 X |
| 4,219,117 | 8/1980 | Weaver et al. | 206/158 X |
| 4,250,682 | 2/1981 | Braun | 53/48 |
| 4,524,568 | 6/1985 | Lancaster et al. | 53/441 X |
| 4,655,028 | 4/1987 | Silbernagel | 53/441 X |

*Primary Examiner*—Robert L. Spruill
*Assistant Examiner*—Linda B. Johnson
*Attorney, Agent, or Firm*—Thomas W. Buckman

[57] ABSTRACT

A combination, or distributor package including upper and lower groups or sub- packages of containers each created by a unitary multi-packaging device, a thin, flexible sheet separating the upper group from the lower group and a tightly, tensioned, envelop around the top, bottom and sides of the groups created by a spirally applied stretch film.

4 Claims, 1 Drawing Sheet

METHOD OF MAKING A FILM ENCASED PACKAGE

BACKGROUND OF THE INVENTION

This invention relates to a combination package for a plurality of containers and method for forming such a package. More specifically the invention relates to a package designed to handle and transport a plurality of containers greater than the unit package typically purchased by the consumer. Packages of this type are sometimes referred to as distributor packages, and are typically in the form of a six-sided paper board or cardboard box in which typically 24 cans are positioned with two layers of 12 cans.

Another typical package of this type utilizes 2 superimposed low height cardboard trays which are overrrapped with a shrink film. Packages of this general type are shown in U.S. Pat. Nos. 3,385,429 or 3,331,503. A shrink film type of package typically requires relatively high energy to shrink the film into a close contact engagement with the packages and containers. It should also be noted that the shrink film does not provide any substantial tension or force upon the containers but is merely a confinement structure.

SUMMARY OF THE INVENTION

Against the foregoing background the present invention represents a clear, unique advance in package design and method of creating such a package.

The package of the present invention basically consists of an array of a plurality of sub-packages. The sub-packages are typically six containers preassembled as a unit using, for example, multi-packaging devices such as those shown in U.S. Pat. Nos. 2,874,835 or 4,219,117.

The sub-packages are arranged in two layers with these layers being separated by a continuous strip of thin flexible material such as paper. A strip of similar thin flexible material is also preferably placed in a continuous fashion beneath the lower layer of sub-packages prior to the application of a spirally wound stretch film. The wound stretch film unitizes at least 24 containers in a tight, dynamically tensioned combination package.

Machinery for applying the spirally applied stretch film does not form a part of this invention per se and may be a variety of available spiral wind machinery, for example, the "Ringmaster" machine currently being sold by Signode Corporation and a machine and method in general shown in U.S. Pat. No. 4,050,220 can be utilized.

The combination of the multi-packaging devices to create sub-packages, and the use of a thin flexible material between the bottoms of the containers in the top layer of sub-packages and the tops of the containers in the lower layer of sub-packages, and the tight, dynamic, overwrapping of the stretch film provides the integrity and unitized package necessary to handle and transport of the large number of containers contemplated by this invention.

Other objects and features of the invention will be apparent upon perusal of the hereinafter specification read in conjunction with the claims.

DESCRIPTION OF THE PREFERRED EMBODIMENT

Figure 1:
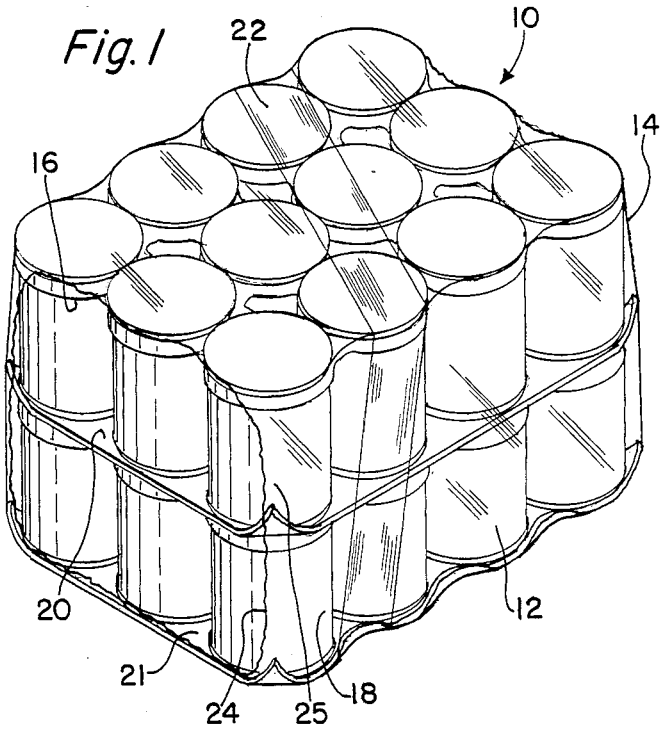
FIG. 1 is a perspective view of the combination package made in accordance with the invention.
Figure 2:
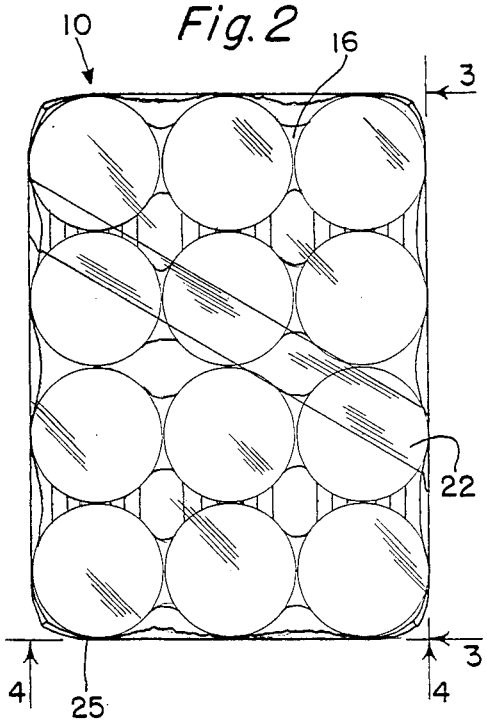
FIG. 2 is a top plan view of the combination package shown in FIG. 1.

Turning first to FIGS. 1–4, the novel structural characteristics of the combination package 10 will be described in detail. The combination package 10 is typically created to unitize, for handling and transportation, a plurality of containers 12. A typical number of such containers to be handled in this manner is 24.

The containers 12 are arrayed in ranks and rows of containers in a manner to be described later and more importantly are assembled into a plurality of sub-packages 14, through the use of a sub-packaging, or multi-packaging device 16. Such a multi-packaging device is typically of a configuration described in U.S. Pat. Nos. 2,874,835 or 4,219,117. Such a device typically is a sheet of polyethylene material having a plurality of apertures created by integral resilient bands. The device is manipulated and assembled to such an array in a known manner using machinery and methods described, for example, in U.S. Pat. Nos. 3,032,943; 3,383,828 and 4,250,682. Such devices 16 are typically positioned in a tight can engaging manner directly adjacent to the top or abutting the chimes of a can.

In the preferred embodiment for such a combination package groups of sub-packaes 14 are arranged so that an upper group 15 is positioned directly over a lower group 17, both groups having an equal number of containers and subpackages thereof. Again in the preferred embodiment two sub-packages of 6 containers apiece create an upper group and two sub-packages of 6 containers apiece create a lower group. A thin sheet of flexible material 20, such as paper, cardboard, plastic or the like is positioned between the upper groups and lower groups and a further thin sheet 21 may be positioned below the lower group of containers.

Figure 3:
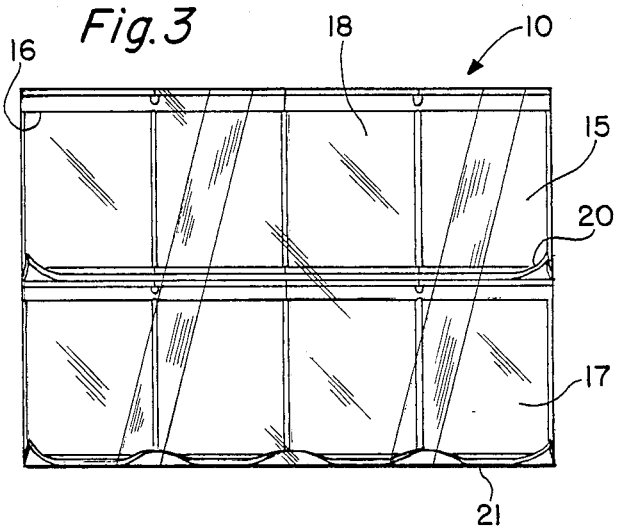
FIG. 3 is a side elevational view of the combination package shown in FIG. 2 and taken in the direction of the lines 3—3 in FIG. 2.
Figure 4:
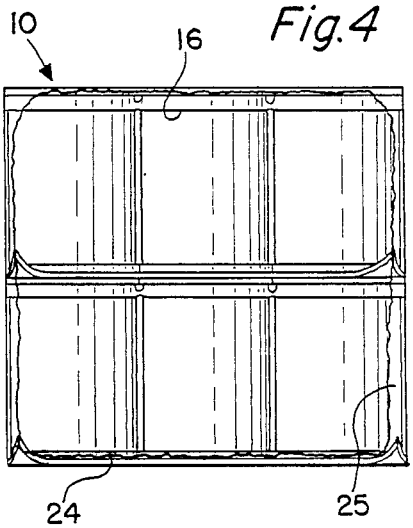
FIG. 4 is an end elevational view of the combination package shown in FIG. 2 and taken in the direction of the lines 4—4 in FIG. 2.
Figure 5:
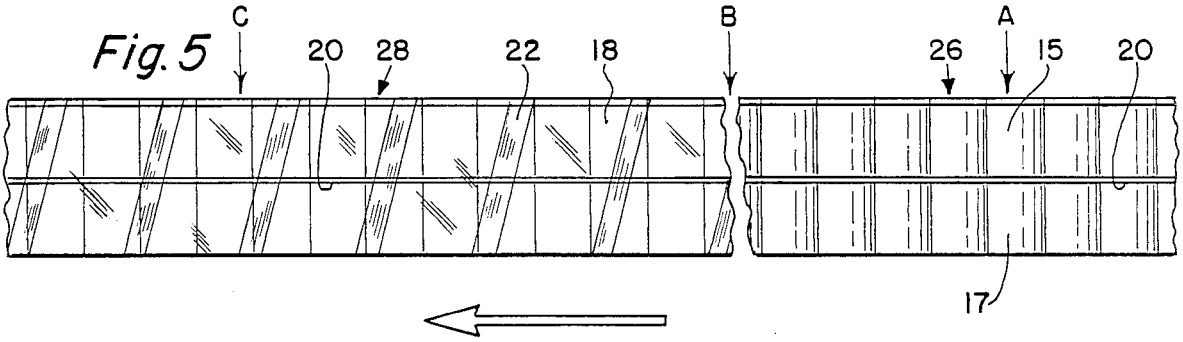
FIG. 5 is a side elevational view of the continuous creation of a plurality of severable packages typified by that shown in FIG. 1.

A continuous web of stretch film 18 is wound about the described array of sub-packages and groups of containers. The film 18 is spirally wound about the length of such an array so that the sides, tops and bottoms of the array are covered while the ends of the array remain uncovered. For example, edges of the film 24 define end panels of the package which is essentially free from engagement or coverage by the film 18. However, due to the tension of the film the edges 24 extend partially around the end containers in the outer rows, as shown at 25 in the Figs. The tension of the film may also cause the corners of the sheets 20 and 21 to be deformed as well as at least the side edges of the lower sheet 21, as shown in FIGS. 1 and 3. These deformations may also aid in the stability of the package.

The film, being spirally wound is preferably overlapped for a predetermined region 22. This overlap depends on the application and the coverage required. The angle of the spiral is determined by the speed of the continuous wrapping and the speed of the continuous movement of the arrays through the apparatus.

A detailed description of the synergism between all the elements of the package will reveal the novel features and functions of this invention.

The very tight envelope created by the stretch film 18 provides the combination package with a unit strength not found in the prior art. For example, the shrink film package described above does not have the dynamic energy of a stretch film and will permit the containers, through the normal jostling and handling in the distribution process to become loose relative to each other and to the package therefore running the risk of cans becoming disassociated with the package during the handling. The stretch film, being resilient and under constant tension of preferably 10–50% stretch in combination with the other elements of the package, enables the movement of the package to withstand the normal handling without such a risk.

The use of such a stretch film with loose cans, however, would be very difficult to achieve since can-to-can point contact as a result of the circular cross-section of the cans in combination with the high dynamic tension created by the film on this array would create a difficult if not impossible situation to maintain the cans in a rank-and-row configuration. Any slight contact or force, externally applied to the package, would force and permit the cans to move relative to one another. Thus, the use of the sub-packages as a stabilizing sub-unit within the combination is an essential ingredient not shown by any prior art.

The use of the thin sheets of material 20 and 21 in a continuous sheet serves to provide vertical stability to the package under the relatively high dynamic forces. Without such a strip of material the containers or sub-packages may tend to piston or move vertically relative to one another, both during the assembly and creation of the packages, and during the use of the packages. Furthermore, the use of a thin layer of paper such as shown in FIGS. 1–5 tends to permit the cans to slightly embed themselves into the surface of the paper under the dynamic force of the film and thus serving to more completely unitize the package. The layers further serve to reduce the abrasion between containers and, between the upper or lower extremities of the cans and the film.

The method of creating of the combination package 10 is advantageous from a material cost and productivity standpoint relative to prior art methods. The sub-packages 16 are created continuously through the use of a typical drum-type applicators as noted above. These sub-packages may then be fed to an area which arrays and arranges them so there is a continuous stream of groups of end-to-end packages created in a lower level and a continuous stream of groups of end-to-end sub-packages created at an upper level.

A continuous roll or web of sheet material 20 is fed between the upper layers and lower layers of sub-packages. A continuous roll or web of sheet 21 may also be fed beneath the lower layer. Thus, a continuous stream of containers 26, which have been preassembled into subpackages, is fed into a suitable stretch wrapping machine, not shown. The group of containers is wrapped by the web at tensions sufficient to stretch the film in the range of 10% to 50%. This continuous stream of preassembled and pregrouped containers as shown at location A in FIG. 5. Location B denotes the throat area of an appropriate stretching machine. Area C is a continuous stream of upper and lower groups of sub-packages in close, contacting succession which have been wrapped with the stretch film 18. The endless stream of combination packages ready to be severed is noted as 28. It is noted that this film 18 creates a spiral orientation about the stream of containers. It is further noted that the stream of containers is continuous and that the ability of the stretch to be tightly associated with the containers is enhanced and in many cases made capable through the use of sub-packaging devices 16 and the continuous strips of material 20. Further in downstream flow of this continuous stream of packages, an appropriate slitting mechanism (not shown) is used to create packages 10. The film is severed at appropriate locations to create edges 24 in a front and rear end panel. Since the combination package includes the sub-packaging units 14, and the continuous strip of thin material 20 and 21, the end panels of packages which are free of any substantial covering by the film, still prevents the containers from falling out of the packages.

Having now described the invention both as a package and a method of making, it should be clearly understood that changes could be made in the described and preferred embodiments by one skilled in the art and still come within the spirit and scope of the hereinafter described claims.

We claim:

1. A method for producing a package for a plurality of containers including the steps of;

forming sub-packages of containers by positioning a first plurality of containers in an integral multipackaging device having resilient bands creating apertures equal in number to the first plurality of containers;

arranging a continuous non-spaced, stream of sub-packages;

placing a continuous strip of, thin, planar flexible material beneath the sub-packages;

moving the non-spaced sub-packages and thin planar material through a stretch wrapping station;

continuously, spirally winding a web of stretch film under tension to stretch wrap the groups of sub-packages;

thus creating a continuous stream of substantially contacting containers, spirally enveloped but adapted to be separated into discrete combination packages by cutting the film an thin planar material perpendicular to the continuous stream between predetermined, adjacent sub-packages.

2. The method of claim 1 further including creating upper and lower groups of sub-packages, and placing an additional, continuous strip of, thin, planar flixible material between the upper groups of non-spaced subpackages and lower groups of non-spaced sub-packages.

3. The method of claim 1 wherein the web of stretch film is tensioned about the series of sub-packages sufficient to stretch in the range of 10% to 50%.

4. The method of claim 1 wherein the sub-packages are formed in 2 by 3 arrays and the continuous stream of sub-packages thereafter arranged to provide three rows of containers.

* * * * *